US011837379B2

(12) United States Patent
Nonen et al.

(10) Patent No.: US 11,837,379 B2
(45) Date of Patent: Dec. 5, 2023

(54) SIGNAL TRANSMISSION CABLE

(71) Applicant: Proterial, Ltd., Tokyo (JP)

(72) Inventors: Hideki Nonen, Tokyo (JP); Hiroshi Ishikawa, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 0 days.

(21) Appl. No.: 17/683,905

(22) Filed: Mar. 1, 2022

(65) Prior Publication Data

US 2022/0285049 A1 Sep. 8, 2022

(30) Foreign Application Priority Data

Mar. 2, 2021 (JP) ..... 2021-032649

(51) Int. Cl.

| | |
|---|---|
| ***H01B 11/18*** | (2006.01) |
| ***H01B 3/30*** | (2006.01) |
| ***H01B 7/22*** | (2006.01) |

(52) U.S. Cl.

CPC ..... *H01B 11/1813* (2013.01); *H01B 3/30* (2013.01); *H01B 7/225* (2013.01); *H01B 11/1834* (2013.01)

(58) Field of Classification Search

None

See application file for complete search history.

(56) References Cited

U.S. PATENT DOCUMENTS

| | | | | | |
|---|---|---|---|---|---|
| 1,948,616 | A * | 2/1934 | Fischer | H01B 11/00 | 174/109 |
| 2,322,702 | A * | 6/1943 | Peterson | H01B 9/027 | 174/106 SC |
| RE24,813 | E * | 4/1960 | Nordlin | H01P 9/02 | 333/163 |
| 3,621,110 | A * | 11/1971 | McGrath | H02G 9/00 | 174/120 FP |
| 4,589,584 | A * | 5/1986 | Christiansen | H05K 3/361 | 228/180.1 |
| 4,687,294 | A * | 8/1987 | Angeles | G02B 6/4436 | 385/102 |
| 4,719,320 | A * | 1/1988 | Strait, Jr. | H01B 11/1878 | 174/109 |
| 6,218,624 | B1 * | 4/2001 | Hanssen | H01B 11/1808 | 174/126.4 |
| 2016/0148725 | A1 * | 5/2016 | Flory | H01B 1/02 | 174/107 |
| 2017/0256837 | A1 | 9/2017 | Ishikawa et al. | | |

FOREIGN PATENT DOCUMENTS

| | | | |
|---|---|---|---|
| JP | H06-52725 | A | 2/1994 |
| JP | 2017-162565 | A | 9/2017 |

* cited by examiner

*Primary Examiner* — Krystal Robinson
(74) *Attorney, Agent, or Firm* — David D. Brush; Westman, Champlin & Koehler, P.A.

(57) ABSTRACT

A signal transmission cable includes at least one internal conductor, an insulator, and an external conductor. The at least one internal conductor is formed in an elongated shape and is configured to transmit a signal. The insulator covers the internal conductor. The external conductor is a band-shaped resin tape having characteristics of an elongation percentage of equal to or more than 30% and a volume resistivity of equal to or less than $4\times10^{-4}$ Ω·cm. The external conductor is configured to be wound around the insulator.

6 Claims, 9 Drawing Sheets

SIGNAL TRANSMISSION CABLE

CROSS-REFERENCE TO RELATED APPLICATIONS

The present application claims priority based on Japanese Patent Application No. 2021-032649 filed to Japanese Patent Office on Mar. 2, 2021, and the content of Japanese Patent Application No. 2021-032649 is incorporated by reference in its entirety.

BACKGROUND

The present disclosure relates to a signal transmission cable.

Signal transmission cables are known. The signal transmission cable includes at least an internal conductor that is a signal line, an insulator that covers the internal conductor, and an external conductor that covers the insulator. The external conductor is hereinafter also referred to as a shield.

Japanese Unexamined Patent Application Publication No. 2017-162565 (Patent Document 1) describes a differential transmission cable. The differential transmission cable includes an internal conductor that is two signal lines, an insulator that covers the internal conductor, and an external conductor. The external conductor is a tape formed in a band shape. The external conductor is configured to be wound around the insulator to cover the insulator.

The external conductor of Patent Document 1 has a conductor layer and an insulator layer. The external conductor is spirally wound around the insulator with the conductor layer facing outward. In other words, the external conductor is transversely wound around the insulator.

Japanese Unexamined Patent Application Publication No. H06-052725 (Patent Document 2) describes a shield cable. The shield cable includes one or two internal conductor lines, an internal insulating member that covers the internal conductor lines, and a shield conductive member that covers the internal insulating member. The shield conductive member of Patent Document 2 is formed by applying liquid synthetic rubber containing conducting particles.

SUMMARY

In the cable of Patent Document 1, a lap part is formed. The lap part is a part where a part of the transversely wound external conductors overlap. The lap part is configured such that the insulator layer of an inner external conductor, the conductor layer of an inner external conductor, the insulator layer of an outer external conductor, and the conductor layer of an outer external conductor are laminated in order from the inside to the outside.

That is, the lap part has the insulator layer of the outer external conductor between the conductor layer of the inner external conductor and the conductor layer of the outer external conductor. Due to the presence of the insulator layer of the outer external conductor, in the cable of Patent Document 1, the conductive layer is put into a periodically discontinuous state in the cable longitudinal direction.

As a result, there is a problem that a suck out, which is a rapid attenuation of a signal component, is likely to occur. In addition, there is a problem that a frequency band in the cable is easily restricted.

In the cable of Patent Document 2, the shield conductive member is formed by applying liquid synthetic rubber containing conducting particles. This cable has a problem that it is difficult to control the thickness of the shield conductive member formed by applying synthetic rubber as compared with a configuration in which an external conductor is formed by winding a band-shaped tape around an insulator.

One aspect of the present disclosure is to provide a signal transmission cable that can suppress occurrence of a suck out in a cable having a structure in which an external conductor is wound around an insulator.

A signal transmission cable according to one aspect of the present disclosure includes at least one internal conductor, an insulator, and an external conductor. The at least one internal conductor is formed in an elongated shape and is configured to transmit a signal. The insulator covers the internal conductor. The external conductor is a band-shaped resin tape having characteristics of an elongation percentage of equal to or more than 30% and a volume resistivity of equal to or less than $4\times10^{-4}$ Ω·cm. The external conductor is configured to be wound around the insulator.

Since the signal transmission cable of the present disclosure is provided with the external conductor in which the band-shaped resin tape having a characteristic of the volume resistivity of equal to or less than $4\times10^{-4}$ Ω·cm is wound around the insulator, a non-conductive layer is not disposed on the overlap part of the resin tape wound around the insulator. In the signal transmission cable of the present disclosure, the state in which the conductivity of the external conductor becomes periodically discontinuous in the cable longitudinal direction is easily eliminated.

The resin tape of the present disclosure is less likely to change in volume resistivity as compared with a metal tape such as a metal foil that is oxidized depending on the use environment to change in volume resistivity. For example, the overlap part of the tape wound around the insulator is hardly oxidized, and the state in which the conductivity of the external conductor becomes periodically discontinuous in the cable longitudinal direction is easily eliminated.

Since the resin tape of the present disclosure is a band-shaped resin tape having an elongation percentage of equal to or more than 30%, the resin tape has an elongation percentage of equal to or more than that of polyester, and the tape is less likely to be cut even when tension is applied when the tape is wound around an insulator, as compared with a metal tape made of a metal foil or the like.

Effects of the Invention

According to the signal transmission cable of the present disclosure, since the signal transmission cable is provided with the external conductor in which the band-shaped resin tape having a characteristic of the volume resistivity of equal to or less than $4\times10^{-4}$ Ω·cm is wound around the insulator, the signal transmission cable achieves an effect of suppressing occurrence of a suck out.

BRIEF DESCRIPTION OF THE DRAWINGS

An example embodiment of the present disclosure will be described hereinafter by way of example with reference to the accompanying drawings, in which.

DETAILED DESCRIPTION OF EXEMPLARY EMBODIMENTS

A signal transmission cable 1 according to an embodiment of the present disclosure will be described with reference to FIGS. 1 to 9. In the present embodiment, a configuration in which the signal transmission cable 1 is a cable compatible with a frequency band of equal to or less than 40 GHz will be described as an example. In addition, a configuration of the signal transmission cable 1 having a diameter of about 1 mm will be described as an example.

Figure 1:
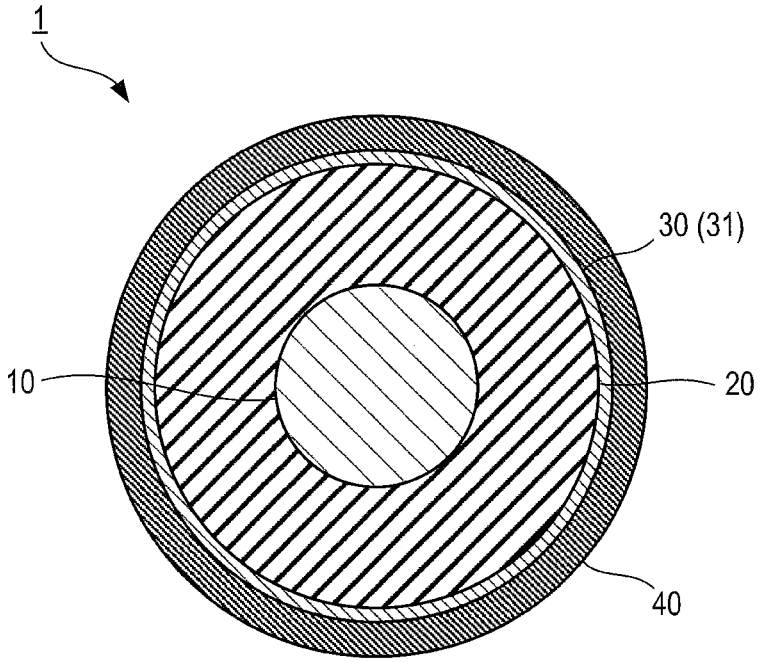
FIG. 1 is a transverse sectional view illustrating a configuration of a signal transmission cable of the present embodiment.

FIG. 1 is a transverse sectional view illustrating the configuration of the signal transmission cable 1 of the present embodiment. As shown in FIG. 1, the signal transmission cable 1 is provided mainly with an internal conductor 10, an insulator 20, an external conductor 30, and a jacket 40.

The internal conductor 10 is a conductor line that transmits a signal and is disposed at the center of the signal transmission cable 1. The internal conductor 10 is a member formed in an elongated shape using a conductive material such as copper (Cu). The elongated shape indicates a shape in which the length in the longitudinal direction is sufficiently long (e.g., a shape of 10 times or more) with respect to the length in a virtual cross section orthogonal to the longitudinal direction (axial direction of the cable 1). In the present embodiment, a configuration in which the internal conductor 10 is a member formed in a columnar shape will be described as an example. The internal conductor 10 may be formed using a conductive material such as a copper alloy, aluminum, or an aluminum alloy.

The insulator 20 is a member that covers the internal conductor 10, and is a member formed using a material having an insulating property. In the present embodiment, a configuration in which the insulator 20 is a member formed in a columnar shape including the internal conductor 10 therein will be described as an example.

In the present embodiment, a configuration in which the insulating material forming the insulator 20 is polyethylene will be described as an example. As an insulating material forming the insulator 20, an insulating material such as polytetrafluoroethylene (PTFE) or tetrafluoroethylene-fuxafluoropropylene copolymer (FEP) may be used, other than polyethylene.

As an insulating material forming the insulator 20, a foamed insulating material such as foamed polyethylene may be used. As a material forming the insulator 20, a material having a permittivity of about 1.5 or more and 3 or less can be used.

Figure 2:
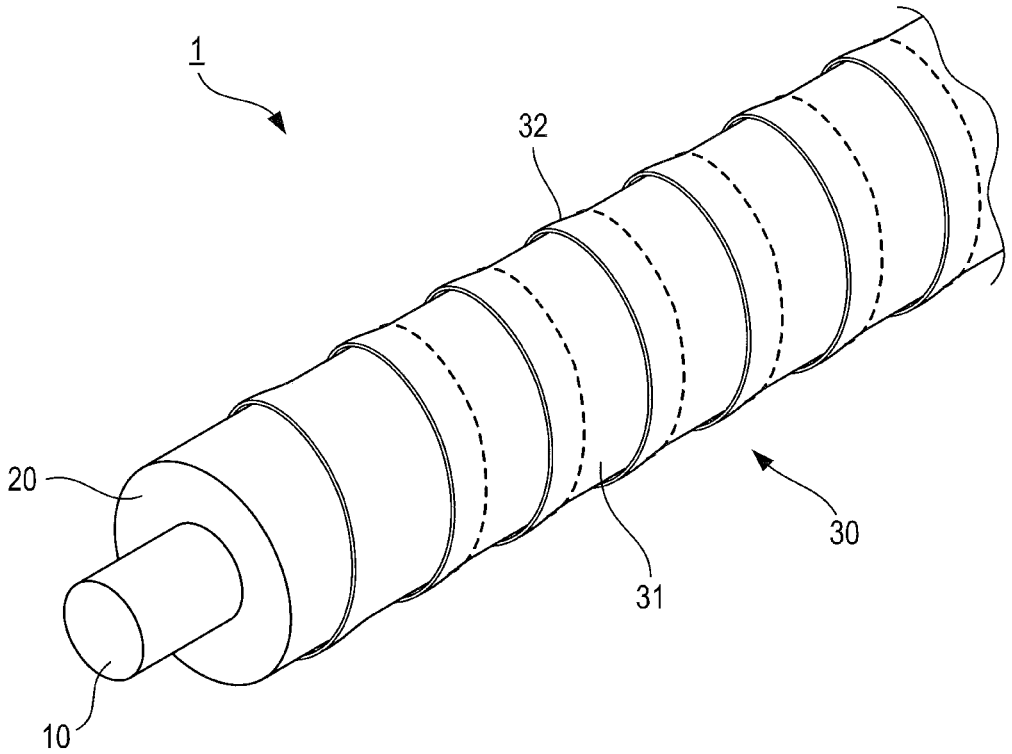
FIG. 2 is a perspective view illustrating a configuration of an internal conductor, an insulator, and an external conductor in FIG. 1.
Figure 3:
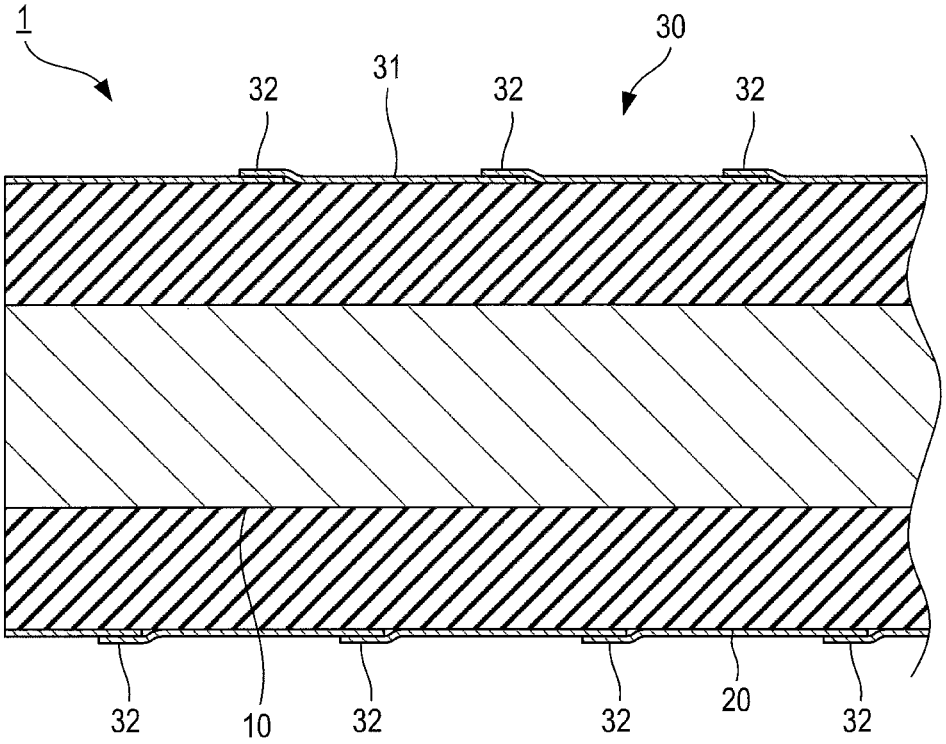
FIG. 3 is a longitudinal sectional view illustrating the configuration of the internal conductor, the insulator, and the external conductor in FIG. 1.

FIG. 2 is a perspective view illustrating the configuration of the internal conductor 10, the insulator 20, and the external conductor 30 in FIG. 1. FIG. 3 is a longitudinal sectional view illustrating the configuration of the internal conductor 10, the insulator 20, and the external conductor 30 in FIG. 1. As shown in FIGS. 2 and 3, the external conductor 30 is a member that covers the insulator 20, and is a member formed by winding a band-shaped resin tape 31 around the insulator 20.

In the present embodiment, a transverse winding configuration in which the resin tape 31 is spirally wound around the insulator 20 will be described as an example. A lap part 32 is formed at the widthwise end of the spirally wound resin tape 31. The lap part 32 is a part where the widthwise ends of the spirally wound resin tape 31 overlap each other.

The resin tape 31 is a member having characteristics of the elongation percentage of equal to or more than the elongation percentage of polyester (e.g., equal to or more than 30%) and the volume resistivity of equal to or less than $4\times10^{-4}$ Ω·cm. The resin tape 31 is a member having an elastic modulus of equal to or less than the elastic modulus of polyester (e.g., equal to or less than 4200 MPa).

In the present embodiment, a configuration in which the elongation percentage of the resin tape 31 is 5000%, the volume resistivity is $3.1\times10^{-4}$ Ω·cm, and the elastic modulus is 3.5 MPa will be described as an example. The elongation percentage of the resin tape 31 is only required to be equal to or more than 30%, and more preferably equal to or more than 300%. The elastic modulus of the resin tape 31 is only required to be equal to or less than 4200 MPa, and more preferably equal to or less than 2800 MPa.

Here, the elongation percentage is a value obtained by an equation $(L0-L)/L0\times100$, where the gauge length of the tensile test piece before the test is L0 and the gauge length of the tensile test piece after breaking is L. The elongation percentage is measured by a method defined in a standard (JIS Z 2241) in advance.

The volume resistivity is an electric resistance value per unit volume. The volume resistivity is measured by a method defined in a standard (JIS K 7194) in advance. The elastic modulus is a value represented by a ratio between tensile stress per unit sectional area and elongation generated in the stress direction. The elastic modulus is measured by a method defined in a standard (JIS K 7161) in advance.

In the present embodiment, a configuration in which the resin tape 31 includes an acrylic elastomer resin and a metallic filler containing silver (Ag) added to the resin will be described as an example.

The resin constituting the resin tape 31 may be an acrylic elastomer resin or another resin having an elongation percentage of equal to or more than that of polyester (equal to or more than 30%) and an elastic modulus of equal to or less than that of polyester (equal to or less than 4200 MPa). The filler constituting the resin tape 31 may be a metallic filler containing silver, or may be a filler containing a conductive material such as carbon or graphene.

In the present embodiment, a configuration of the resin tape 31 having a width of about 10 mm and a thickness of several hundred μm will be described as an example. The width of the resin tape 31 may be about 10 mm, may be shorter than 10 mm, or may be longer than 10 mm. The thickness of the resin tape 31 may be several hundred μm, or may be a predetermined thickness of equal to or more than 100 μm and equal to or less than 1 mm.

The jacket 40 is a member that covers the external conductor 30 as shown in FIG. 1. As a material for forming the jacket 40, for example, polyvinyl chloride (PVC) can be used. For the jacket 40, a material used in a general cable can be used, and the material is not particularly limited.

Figure 4:
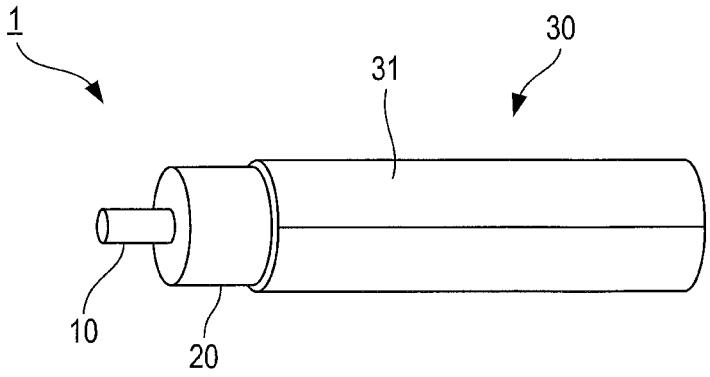
FIG. 4 is a perspective view illustrating another winding method of a resin tape in the external conductor.

FIG. 4 is a perspective view illustrating another winding method of the resin tape 31 on the external conductor 30. The resin tape 31 may be wound around the insulator 20 in a transversely winding manner as described above, or may be wound around the insulator 20 in a longitudinally attaching manner as shown in FIG. 4.

Figure 5:
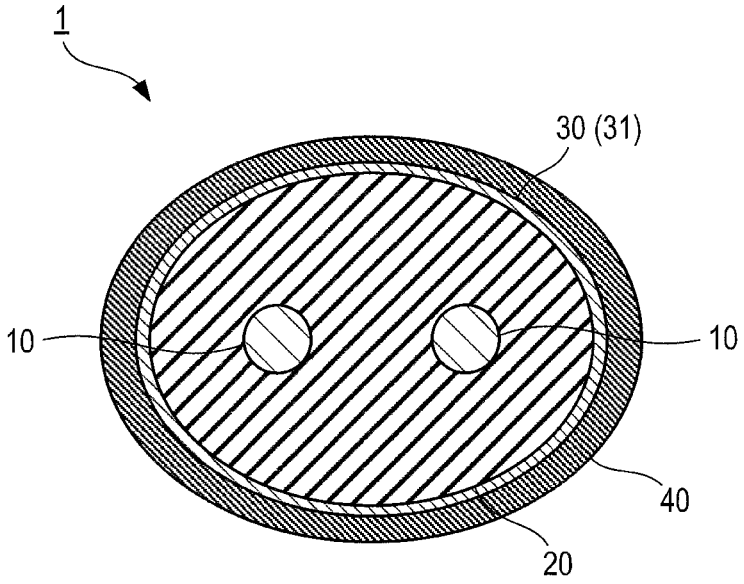
FIG. 5 is a transverse sectional view illustrating a configuration of a signal transmission cable of another aspect.

In the above embodiment, the signal transmission cable 1 has been described with an example of a configuration in which the internal conductor 10 is one coaxial cable, but the present invention is not limited to this configuration. As shown in FIG. 5, the signal transmission cable 1 may be a cable having a two-core collective covering structure (e.g., differential transmission cable). The two-core collective covering structure is a structure in which two internal conductors 10 are provided and the insulator 20 collectively covers the two internal conductors 10. Note that the signal transmission cable 1 may have a configuration including three or more internal conductors 10.

An insertion loss (hereinafter, also referred to as "SDD21") in the differential mode in a case where the above-described signal transmission cable 1 is a cable having a two-core collective covering structure will be described with reference to FIGS. 6 and 7. Note that the SDD21 is one of parameters serving as a measure of signal quality loss of differential mode transmission in a cable having the two-core collective covering structure.

Figure 6:
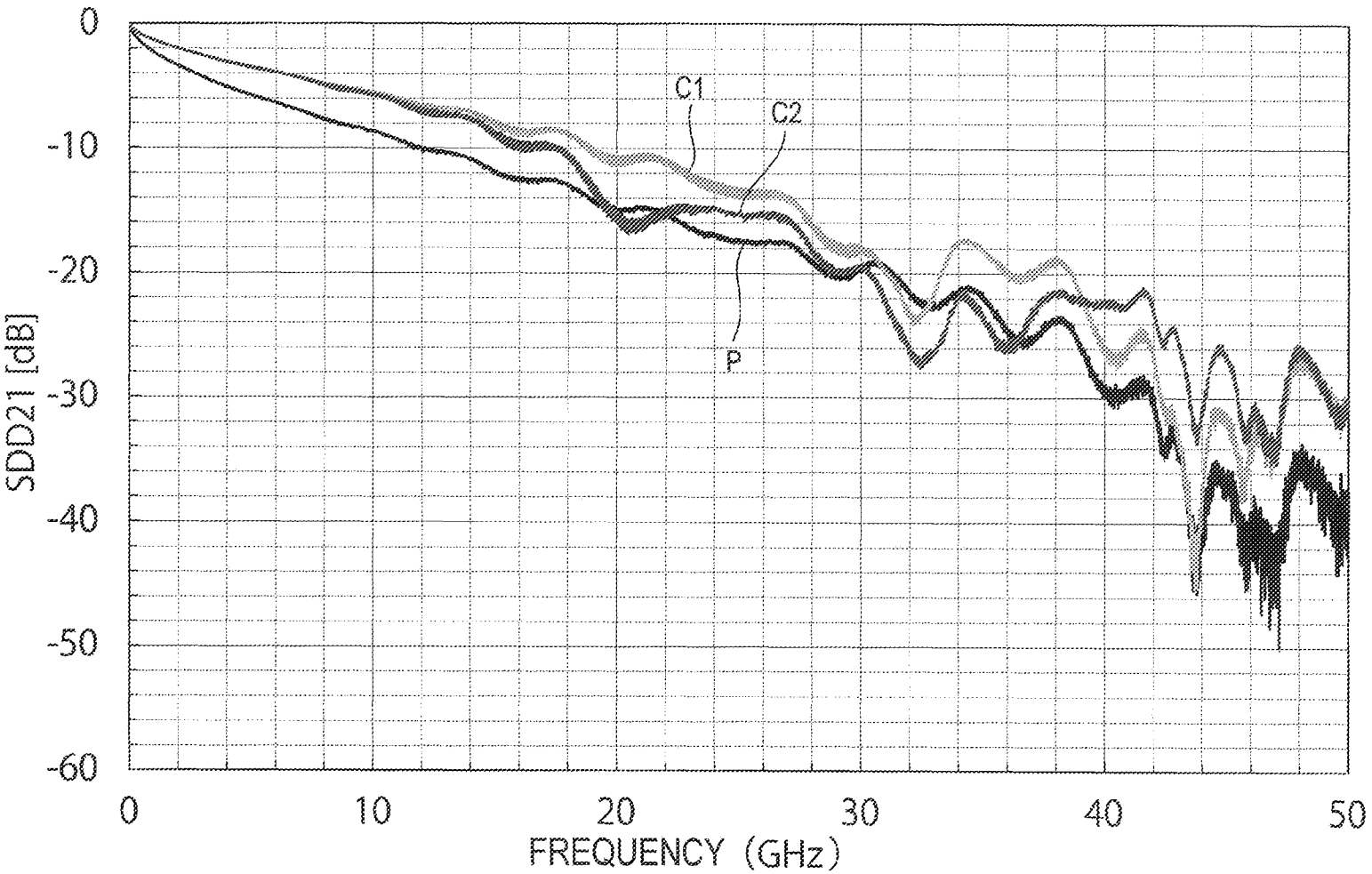
FIG. 6 is a graph illustrating an insertion loss in a differential mode in the signal transmission cable of FIG. 5.

FIG. 6 is a graph illustrating the SDD21 in the signal transmission cable 1. FIG. 7 is a graph illustrating the SDD21 in a conventional signal transmission cable.

FIG. 6 includes a graph P, a graph C1, and a graph C2. The graph P is a measurement result in the signal transmission cable 1 of the present embodiment. The graph C1 is a measurement result in a first comparative cable having an external conductor formed by copper plating. The graph C2 is a measurement result in a second comparative cable having an external conductor in which a tape formed of a copper foil and polyethylene terephthalate (PET) is longitudinally attached to the insulator 20.

Figure 7:
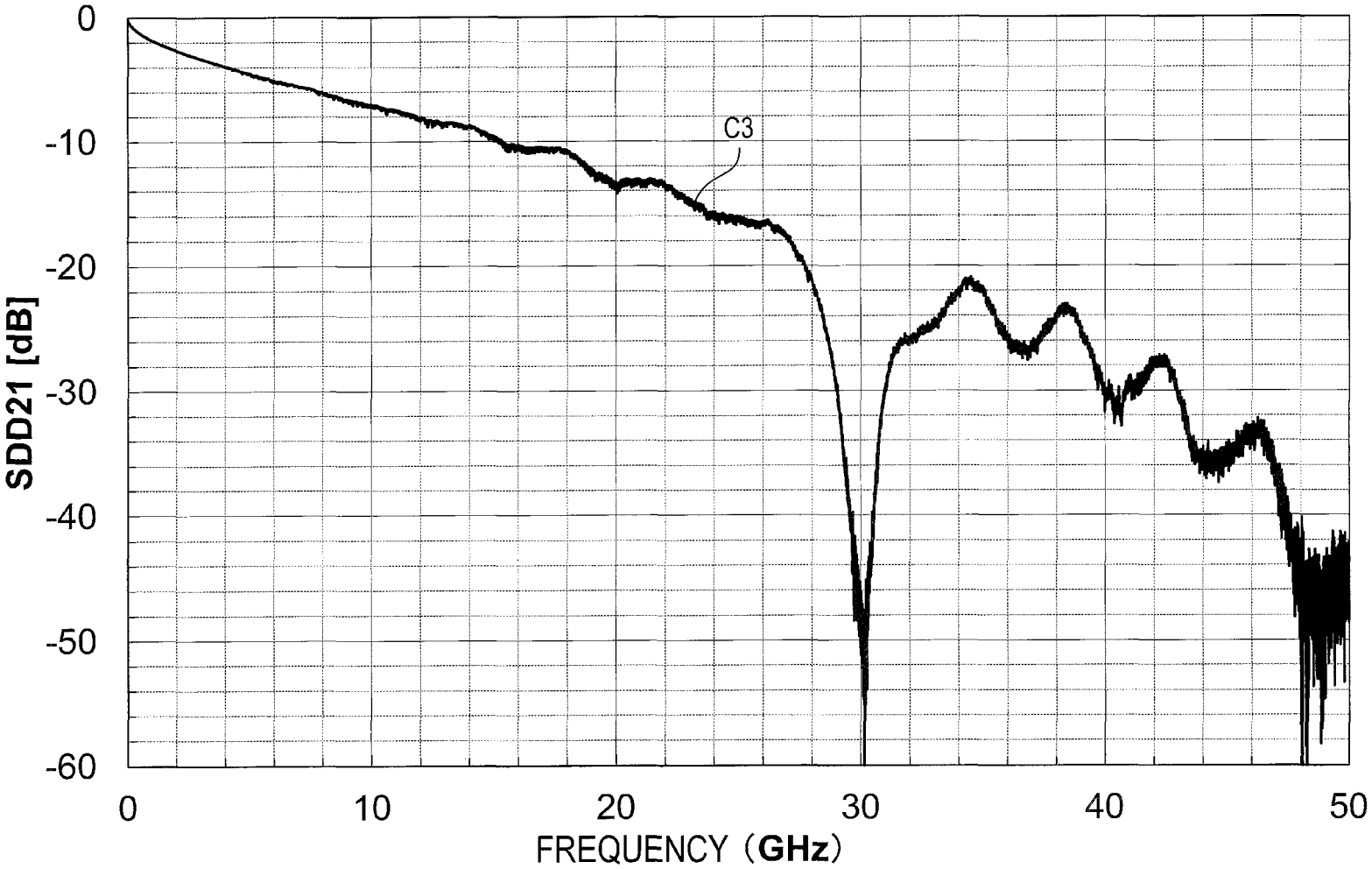
FIG. 7 is a graph illustrating an insertion loss in a differential mode in a conventional signal transmission cable.

FIG. 7 includes a graph C3 of a measurement result in a conventional cable having an external conductor in which a tape formed of a copper foil and polyethylene terephthalate (PET) is transversely wound around the insulator 20.

For the signal transmission cable 1, the first comparative cable, the second comparative cable, and the conventional cable, which are used for the measurement of the SDD21, the internal conductor 10 having a diameter of 30 American Wire Gauge (AWG) and a length of 1 m is used.

Figure 8:
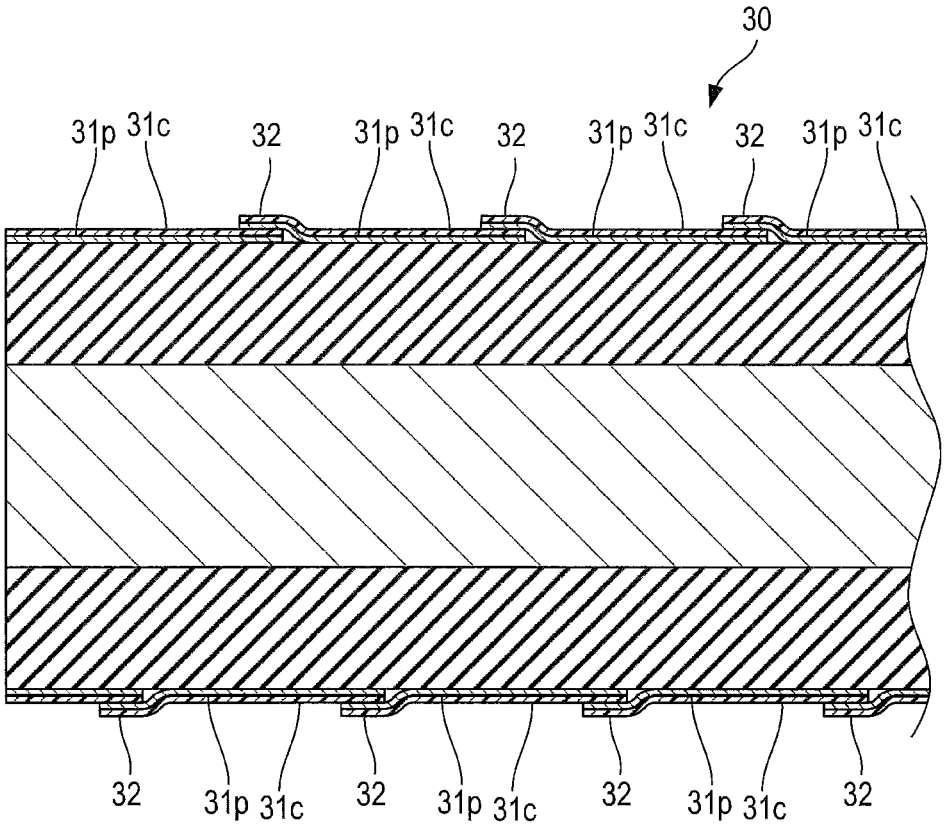
FIG. 8 is a transverse sectional view illustrating a configuration of a conventional signal transmission cable.

As shown in FIG. 8, the external conductor 30 of the conventional cable is configured by sequentially laminating, in the lap part 32 where the transversely wound tapes overlap, a PET layer 31*p* of the inner tape, a copper foil layer 31*c* of the inner tape, a PET layer 31*p* of an outer tape, and a copper foil layer 31*c* of the outer tape. That is, the external conductor 30 of the conventional cable has a structure in which conductivity becomes periodically discontinuous in the cable longitudinal direction, and has a structure in which a suck out occurs.

FIG. 7 shows that the SDD21 drops to about −60 dB in the vicinity of 30 GHz in the graph C3. That is, it is indicated that in the conventional cable, a suck out has occurred.

On the other hand, the graph P shown in FIG. 6 does not show a large drop in the SDD21 as in the graph C3. The graph P indicates that the conductivity of the external conductor is not periodically discontinuous in the cable longitudinal direction, and the suck out hardly occurs. Similarly to the graph C1 of the first comparative cable and the graph C2 of the second comparative cable, the graph P does not show a large drop in the SDD21.

That is, it is shown that an occurrence of the suck out is suppressed in the signal transmission cable 1 as compared with the conventional cable. It is that an occurrence of the suck out is suppressed in the signal transmission cable 1 to the same extent as the first comparative cable and the second comparative cable in which the suck out hardly occurs.

According to the signal transmission cable 1 having the above configuration, since the signal transmission cable 1 is provided with the external conductor 30 in which the band-shaped resin tape 31 having a characteristic of the volume resistivity of equal to or less than $4\times10^{-4}$ S2 cm is wound around the insulator 20, a non-conductive layer is not disposed on the lap part 32 where the resin tape 31 wound around the insulator 20 overlaps. In the signal transmission cable 1, a state in which the conductivity of the external conductor 30 becomes periodically discontinuous in the cable longitudinal direction is easily eliminated. In other words, the signal transmission cable 1 can easily suppress the occurrence of the suck out.

In the signal transmission cable 1, the resin tape 31 is less likely to change in volume resistivity as compared with a metal tape such as a metal foil that is oxidized depending on the use environment to change in volume resistivity. For example, in the signal transmission cable 1, the lap part 32 where the tape wound around the insulator 20 overlaps is hardly oxidized, and the state in which the conductivity of the external conductor 30 becomes periodically discontinuous in the cable longitudinal direction is easily eliminated. In other words, the signal transmission cable 1 can easily suppress the occurrence of the suck out.

Since the member that covers the insulator 20 is the band-shaped resin tape 31 having an elongation percentage of equal to or more than 30%, the signal transmission cable 1 has the elongation percentage of equal to or more than that of polyester. As compared with a metal tape such as a metal foil, the resin tape 31 is less likely to be cut even when tension is applied when the tape is wound around an insulator. In other words, the configuration including the resin tape 31 makes it easy to form the external conductor 30, and makes it easy to manufacture the signal transmission cable 1.

By setting the elastic modulus to equal to or less than 4200 MPa, the resin tape 31 has an elastic modulus of equal to or less than that of polyester. As compared with a metal tape such as a metal foil, the resin tape 31 is less likely to be cut even when tension is applied when the tape is wound around the insulator 20. In other words, the configuration including the resin tape 31 makes it easy to form the external conductor 30, and makes it easy to manufacture the signal transmission cable 1.

By setting the thickness to equal to or more than 100 μm, the resin tape 31 is less likely to be cut even when tension is applied when the tape is wound around the insulator 20 as compared with a case where the thickness is set to less than 100 μm. By setting the thickness to equal to or less than 1 mm, the resin tape 31 is easily wound along the shape of the insulator 20 as compared with a case where the thickness is set to more than 1 mm. In other words, the configuration including the resin tape 31 makes it easy to form the external conductor 30, and makes it easy to manufacture the signal transmission cable 1.

By containing a resin whose elongation percentage is equal to or more than the elongation percentage of polyester, the resin tape 31 is less likely to be cut even when tension is applied when the tape is wound around the insulator 20 as compared with a metal tape such as a metal foil.

By containing a filler having conductivity, the resin tape 31 easily has a volume resistivity of equal to or less than $4\times10^{-4}$ Ω·cm as compared with a case where the filler having conductivity is not contained.

In the present embodiment, the configuration in which the signal transmission cable 1 includes the internal conductor 10, the insulator 20, the external conductor 30, and the jacket 40 has been described as an example. However, as shown in FIG. 9, a braided wire 50 may be provided between the external conductor 30 and the jacket 40.

The braided wire 50 is configured to cover the periphery of the external conductor 30. As a material of the braided wire 50, a material used in a general cable can be used. Also for the configuration of the braided wire 50, a configuration used in a general cable can be used.

Figure 9:
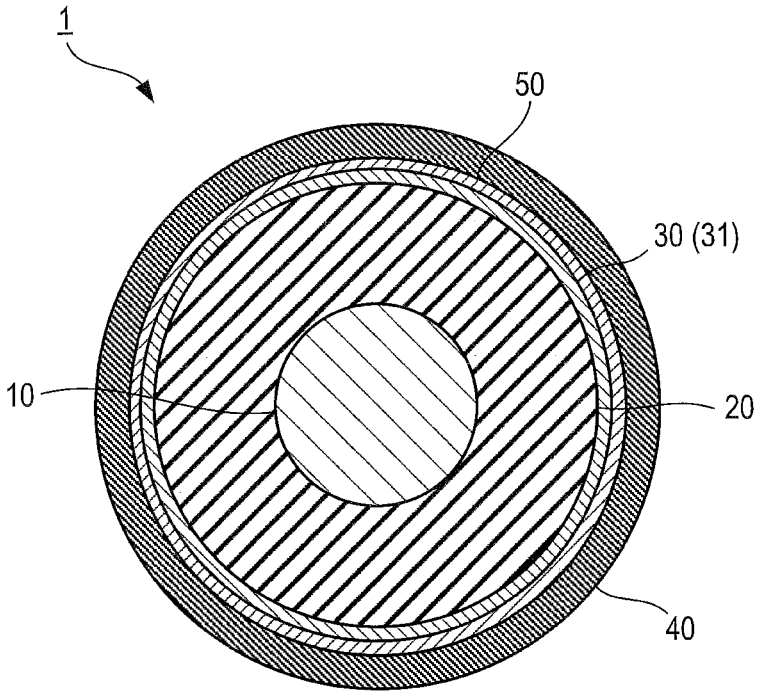
FIG. 9 is a transverse sectional view illustrating a configuration of a signal transmission cable of yet another aspect.

Since the signal transmission cable 1 shown in FIG. 9 has a configuration in which the periphery of the external conductor 30 is covered with the braided wire 50, in other words, a configuration in which the resin tape 31 of the external conductor 30 is covered with the braided wire 50, the resin tape 31 wound around the insulator 20 is easily fixed. The signal transmission cable 1 can be configured such that noise hardly enters the internal conductor 10 from the outside. Furthermore, the signal transmission cable 1 can be configured to easily reduce a loss in a low frequency band.

Note that the technical scope of the present disclosure is not limited to the above embodiment, and various modifications can be made without departing from the gist of the present disclosure.

What is claimed is:

1. A signal transmission cable comprising:

at least one internal conductor that is formed in an elongated shape for transmitting a signal;

an insulator that covers the internal conductor; and an external conductor in which a band-shaped resin tape having characteristics of an elongation percentage of equal to or more than 300% and a volume resistivity of equal to or less than $4\times10^{-4}$ Ω·cm is wound around the insulator, wherein the external conductor comprises a lap part in which widthwise ends of the resin tape overlap each other and a non-conductive layer is not disposed, and wherein the resin tape comprises an acrylic elastomer resin.

2. The signal transmission cable according to claim 1, wherein the resin tape has an elastic modulus of equal to or less than 2800 MPa.

3. The signal transmission cable according to claim 1, wherein the resin tape has a thickness of equal to or more than 100 μm and equal to or less than 1 mm.

4. The signal transmission cable according to claim 1, wherein the resin tape includes a resin having an elongation percentage equal to or more than an elongation percentage of polyester, and a filler having conductivity added to the resin.

5. The signal transmission cable according to claim 1 further comprising a braided wire that covers the external conductor.

6. The signal transmission cable according to claim 1, wherein the resin tape comprises the acrylic elastomer resin to which a metallic filler containing silver is added.

* * * * *